US008961704B2

(12) United States Patent
Haltmayer et al.

(10) Patent No.: US 8,961,704 B2
(45) Date of Patent: Feb. 24, 2015

(54) DISHWASHER

(75) Inventors: Werner Haltmayer, Dinkelsbühl (DE); Mathias Herrmann, Nattheim (DE); Stefan Kasbauer, Dillingen (DE); Claus Köther, Niederstotzingen (DE); Martin Weissenburger, Bissingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1218 days.

(21) Appl. No.: 12/431,364

(22) Filed: Apr. 28, 2009

(65) Prior Publication Data

US 2009/0277485 A1 Nov. 12, 2009

(30) Foreign Application Priority Data

May 8, 2008 (DE) ..... 10 2008 022 741

(51) Int. Cl.
*A47L 15/42* (2006.01)
*A47L 15/48* (2006.01)

(52) U.S. Cl.
CPC ..... *A47L 15/4246* (2013.01); *A47L 15/488* (2013.01); *A47L 15/4217* (2013.01)
USPC ..... 134/56 D

(58) Field of Classification Search
CPC ..... A47L 15/488
USPC ..... 134/56 D
See application file for complete search history.

(56) References Cited

U.S. PATENT DOCUMENTS

| | | | | |
|---|---|---|---|---|
| 6,349,731 | B1 * | 2/2002 | Schaaf et al. | 134/114 |
| 7,673,480 | B2 * | 3/2010 | Hygema | 68/207 |
| 2005/0241683 | A1 * | 11/2005 | Jeong | 134/58 D |
| 2008/0264455 | A1 * | 10/2008 | Brewer et al. | 134/95.2 |

FOREIGN PATENT DOCUMENTS

| | | | | |
|---|---|---|---|---|
| DE | 7206233 | | 8/1972 | |
| DE | 3705136 | A1 * | 9/1988 | D06F 39/08 |
| DE | 102007041305 | A1 | 3/2009 | |
| EP | 0768059 | A2 | 4/1997 | |

* cited by examiner

*Primary Examiner* — Michael Barr
*Assistant Examiner* — Jason Riggleman
(74) *Attorney, Agent, or Firm* — James E. Howard; Andre Pallapies

(57) ABSTRACT

A dishwasher includes a washing container having a washing chamber, a water feed line for filling the washing chamber with liquid, and a water inlet device connected on an inlet side to the water feed line and ending in the washing chamber on an outlet side. The water inlet device includes a steam outlet opening that ducts water vapor out of the washing container. The water inlet device prevents a negative-pressure-induced reversal of flow against the filling direction in the water feed line.

20 Claims, 3 Drawing Sheets

Detail Z

DISHWASHER

BACKGROUND OF THE INVENTION

Dishwashers are equipped with what is termed a water inlet or water inlet device via which the appliance is filled with fresh water, i.e. mains water.

A generic dishwasher has such a water inlet device, the housing of which is provided with an inlet opening to which a fresh water feed line is connected. On the outlet side the housing of the water inlet device opens via a first washing container opening into a washing chamber of a washing container of the dishwasher. During a wash cycle the washing container can be filled with fresh water via the water inlet device.

The water inlet device also has an expansion system which is assigned to the washing chamber. An expansion in the volume of air or water vapor enclosed in the washing chamber during the time it is being heated can be balanced out by way of the expansion system. For that purpose an expansion line leads into the washing chamber. At the same time it must be ensured that if negative pressure occurs in the water feed line, e.g. due to corresponding flow conditions in a domestic water supply system, liquid cannot escape from the dishwasher into the domestic water supply system due to the suction effect of the negative pressure.

BRIEF SUMMARY OF THE INVENTION

An object of the invention consists in providing a dishwasher in which, if negative pressure is present, liquid is reliably prevented from escaping into a domestic water supply system.

The solution proceeds on the basis of a dishwasher having a washing container having a washing chamber and a water inlet device which is connected to a water feed line for filling the washing chamber with liquid on the inlet side and ends in the washing chamber on the outlet side, and which has a steam outlet opening for ducting water vapor out of the washing container. The water inlet device fulfills a dual function in that it both fills the washing container with fresh water and equalizes the pressure via the additional steam outlet opening.

An exemplary embodiment of the invention prevents a negative-pressure-induced reversal of flow against the filling direction in the water feed line. In this way it is ensured that if negative pressure occurs no liquid can escape from the washing container into a domestic water supply system.

Preferably an embodiment includes a ventilation opening for equalizing the pressure if negative pressure occurs. In this way the negative pressure is dissipated through the ventilation opening, thereby ensuring that no suction effect can occur due to negative pressure.

An expansion line can be connected at the steam outlet opening of the water inlet device to provide a condensation route for the exiting water vapor, along which route the water vapor condenses and can be collected as condensate. The water vapor is guided by the expansion line to a defined point without condensing on adjacent kitchen unit walls of an installation recess. The expansion line can be an economical flexible hose line which is routed upward in a loop-like vertical guide starting from the steam outlet opening and whose outlet end can be arranged in a defined location preferably below the washing container opening.

The water inlet device is connected to a water supply network via the water feed line. As also in the case of other water-conducting domestic appliances, dishwashers are equally subject to the requirement whereby no washing liquid must be sucked back into the water supply network. This requirement is checked by the relevant test institutes in a test procedure in which the water feed line is subjected to negative pressure.

In order to fulfill the aforesaid requirement the housing of the water inlet device can have a ventilation opening. In the above-described test case ambient air can be sucked into the water feed line via the ventilation opening, and moreover instead of water vapor and/or washing liquid from the washing chamber.

The housing of the water inlet device is preferably secured in the region of the container opening. The expansion hose already mentioned above can be routed in a free hose-guiding manner along the external side wall of the washing container. In the same way the fresh water feed line can also be routed along the external side wall of the washing container to the water inlet device. In order to provide a defined line guide, retaining clips are provided which secure the water feed line or expansion line and/or a drain line in position. The retaining clips can preferably be integrated on the housing of the water inlet device. Against this background the housing of the water inlet device can preferably be an injection-molded plastic part.

To provide a simple housing geometry with a reduced number of openings, fresh water can be fed or routed into the housing via the ventilation opening. The ventilation opening therefore fulfills a dual function, serving simultaneously also as a water inlet opening of the housing.

When the washing container is filled with fresh water, the water flow in the water feed line can therefore be routed through the ventilation opening into the housing and onward into the washing container.

A ventilation space that is exposed to the outside can preferably be embodied between the water feed line and the housing inlet opening. In a simple embodiment the water feed line can project into the housing inlet opening, for example. In this case the housing inlet opening cross-section not occupied by the water feed line can be exposed to the outside.

To allow simple water or steam guiding the housing inlet opening and/or the housing steam outlet opening can be provided on the top side of the housing. The housing inlet opening can be covered by a hood-like cover in order to shield it from outside influences.

In order to separate the water inlet function from the pressure equalization function further, the housing of the water inlet device can have a water inlet chamber and a steam outlet chamber separated therefrom by a partition. The water feed line can lead into the water inlet chamber of the housing, while the steam outlet opening and/or the washing-container-side opening can lead into the steam outlet chamber. Accordingly, when the washing container is filled the fresh water is first channeled into the water inlet chamber. From there the fresh water flows further by way of the steam outlet chamber into the washing chamber of the washing container. In order to enable the fresh water to flow immediately and fully into the washing chamber, the two chambers are connected to each other via a connection opening which is preferably embodied between the partition and a housing base side of the water inlet. In this way no additional overflow edge between the two chambers has to be surmounted by the fresh water.

A steam duct is also preferably provided so that steam can be ducted to the steam outlet opening. In this way steam is simultaneously reliably prevented from escaping into the water feed line and consequently also into the domestic water supply system under certain conditions.

In this case the steam duct is between the two chambers, thereby producing a particularly simple structure.

It is also preferably provided that a cross-section connecting the washing chamber to the water feed line is reduced in size compared to a cross-section connecting the washing chamber to the steam outlet opening due to the steam duct. The narrowing in cross-section causes steam to be directed toward the steam outlet opening.

BRIEF DESCRIPTION OF THE DRAWINGS

An exemplary embodiment of the invention is described below with reference to the attached figures, in which.

DETAILED DESCRIPTION OF THE PRESENT INVENTION

Figure 1:
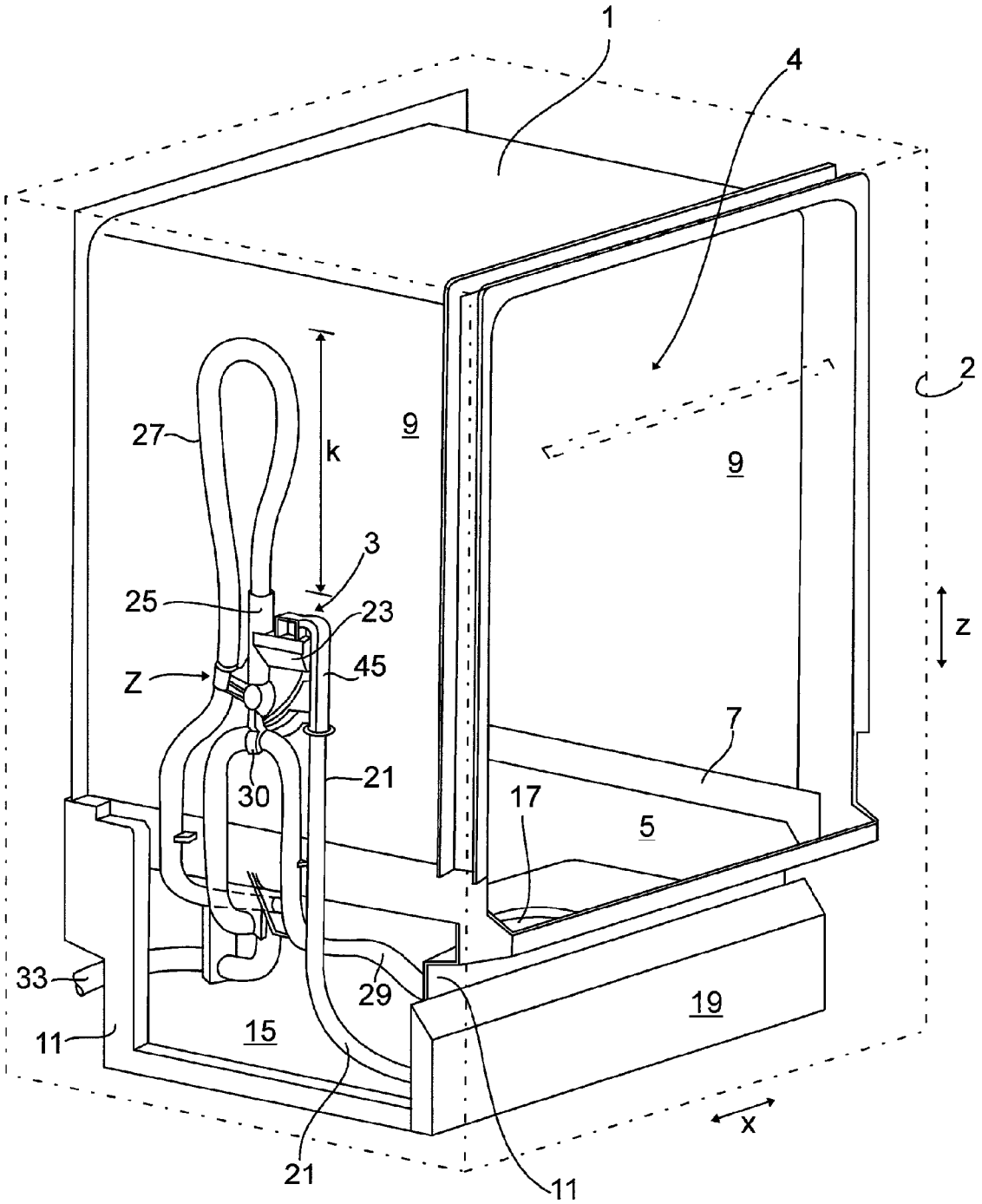
FIG. 1 shows a dishwasher in a roughly schematic view.

Referring to FIG. 1, a dishwasher is shown in a roughly schematic perspective view. For clarity of illustration reasons the housing walls and the appliance door 2 of the dishwasher are indicated by a dash-dotted outline. In the interest of easier understanding of the invention only a washing container 1 with externally arranged water inlet or a water inlet device 3 as well as with the associated liquid lines is shown, while the further appliance components such as, say, circulating pump, drain pump or control electronics components have been omitted from the illustration.

In FIG. 1 the washing container base wall 5 is an injection-molded plastic part. The base wall 5 is provided with laterally raised edge sides 7 on which the side walls 9 and the rear wall of the washing container 1 rest. The side walls 9 and the rear wall are stainless steel sheet.

The base wall 5 delimiting the washing chamber 4 of the washing container 1 is reinforced on the base side by means of lateral supporting profiles 11. Formed below the base wall 5 is an installation space 15 in which appliance components such as, say, a pump sump 17 or the circulating and drain pumps (not shown) are arranged.

The installation space 15 is covered at the front by means of a front panel 19 provided beneath the appliance door 2. Located immediately behind the front panel 19 is an appliance-side water inlet valve (not shown). As is well-known, a feed hose (also not shown) routed to the water supply network is connected to the water inlet valve. Additionally connected to the water inlet valve is a water feed line 21 which leads to a housing 23 of the water inlet device 3.

The housing 23 of the water inlet device 3 has a connecting piece 25 to which an expansion line 27 is connected which is initially routed upward along the washing container side wall 9 in a loop-like vertical guide and then downward in the opposite direction into the installation space 15. Shown in addition is a drain hose 29 coming from the pump sump 17 or drain pump, said drain hose 29 likewise being routed upward in a loop shape along the side wall 9. At its upward-pointing curved section the drain hose 29 is secured by means of a retaining clip 30 integrated on the housing 23. At the rear of the appliance the end of the hose is mounted in a further retaining element 31 and fluidically connected to an external drain line 33.

Figure 3:
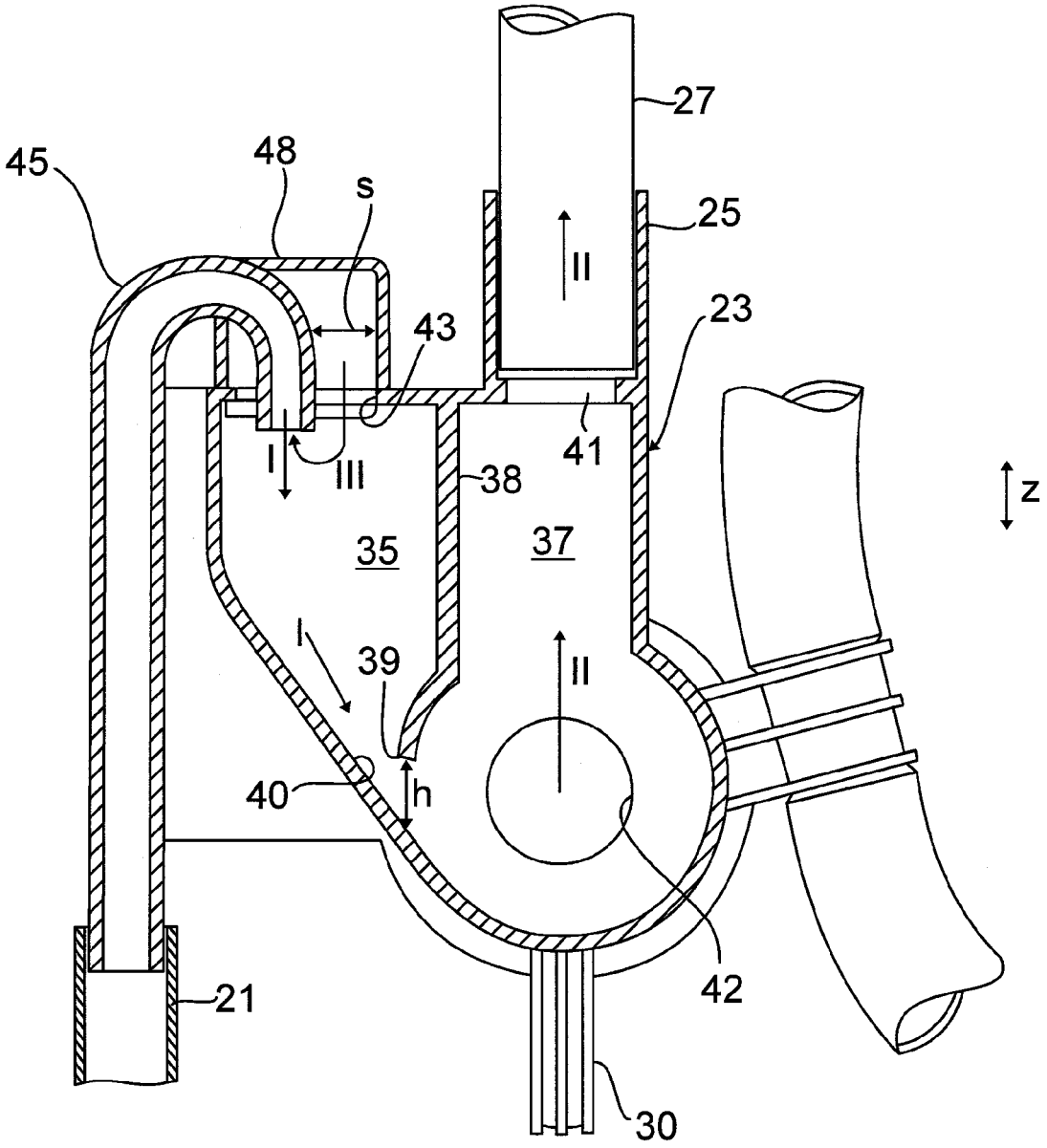
FIG. 3 shows the water inlet device in a sectional view.

The housing 23 of the water inlet device 3 leads via a washing container opening 42 shown in FIG. 3 into the washing chamber 4 of the washing container 1. When the washing container 1 is filled with fresh water the front-side water inlet valve (not shown) is opened, as a result of which fresh water is routed from the water supply network via the water feed line 21 in a flow direction I into the housing 23 of the water inlet device 3. From there it flows into the washing chamber 4 via the washing container opening 42.

Also effected via the water inlet device 3 in addition to the water inlet function is a pressure equalization wherein air or water vapor heated in the washing chamber 4 is forced through the housing 23 into the expansion line 27 as a result of an expansion in volume. The expansion line 27 is routed by its free end right into the installation space 15 beneath the washing container 1 into a defined end position.

The housing 23 of the water inlet device 3 shown in isolation in FIG. 3 is formed as an injection-molded plastic part. According to FIG. 3, the interior of the housing is subdivided into a water inlet chamber 35 and a steam outlet chamber 37. The two chambers 35, 37 are separated from each other via a partition 38 acting as a steam duct and having a curved section 39, a connection opening being provided for fluidically connecting the two chambers 35, 37. The connection opening is formed between a housing base side 40 and a partition 38 spaced apart therefrom at a free height h.

The steam outlet chamber 37 is connected to the expansion line 27 via a steam outlet opening 41 enclosed by the connecting piece 25. In addition the steam outlet chamber 37 leads into the washing chamber 4 via the container opening 42 in the washing container side wall 9. According to FIG. 3, in this arrangement the steam outlet opening 41 covers the container opening 42 in a vertical axis direction z, thereby minimizing a free travel path of the rising steam between the container opening 42 and the steam outlet opening 41. In the event of an expansion in the volume of the air or water vapor in the washing chamber 4, the heated water vapor or air can therefore flow through the container opening 42 into the steam outlet chamber 37 of the housing 23 in order to equalize the pressure. The water vapor then rises in the direction of the arrow II along the partition 38 upward into the expansion line 27. The part of the expansion tube 27 led vertically upward from the connecting piece 25 serves as a condensation route k along which the steam condenses and is ducted back into the steam outlet chamber 37 as condensate.

In the event that the appliance door 2 is opened briefly during a wash cycle, what is termed an "expansion shock" can occur wherein the air entering the washing chamber 4 from outside is abruptly heated and consequently an excessively large amount of steam or air is ducted into the expansion hose 27. In this case the volume of steam cannot fully condense along the condensation route k. Rather, some of the water vapor can travel beyond the condensation route k and be ducted via the expansion hose 27 in a defined manner into the installation space 15. If an expansion shock occurs, a condensation of steam on kitchen unit side walls inside an installation recess of the dishwasher is therefore prevented. Instead, a defined escape of steam takes place in the region of the installation space 15.

Figure 2:
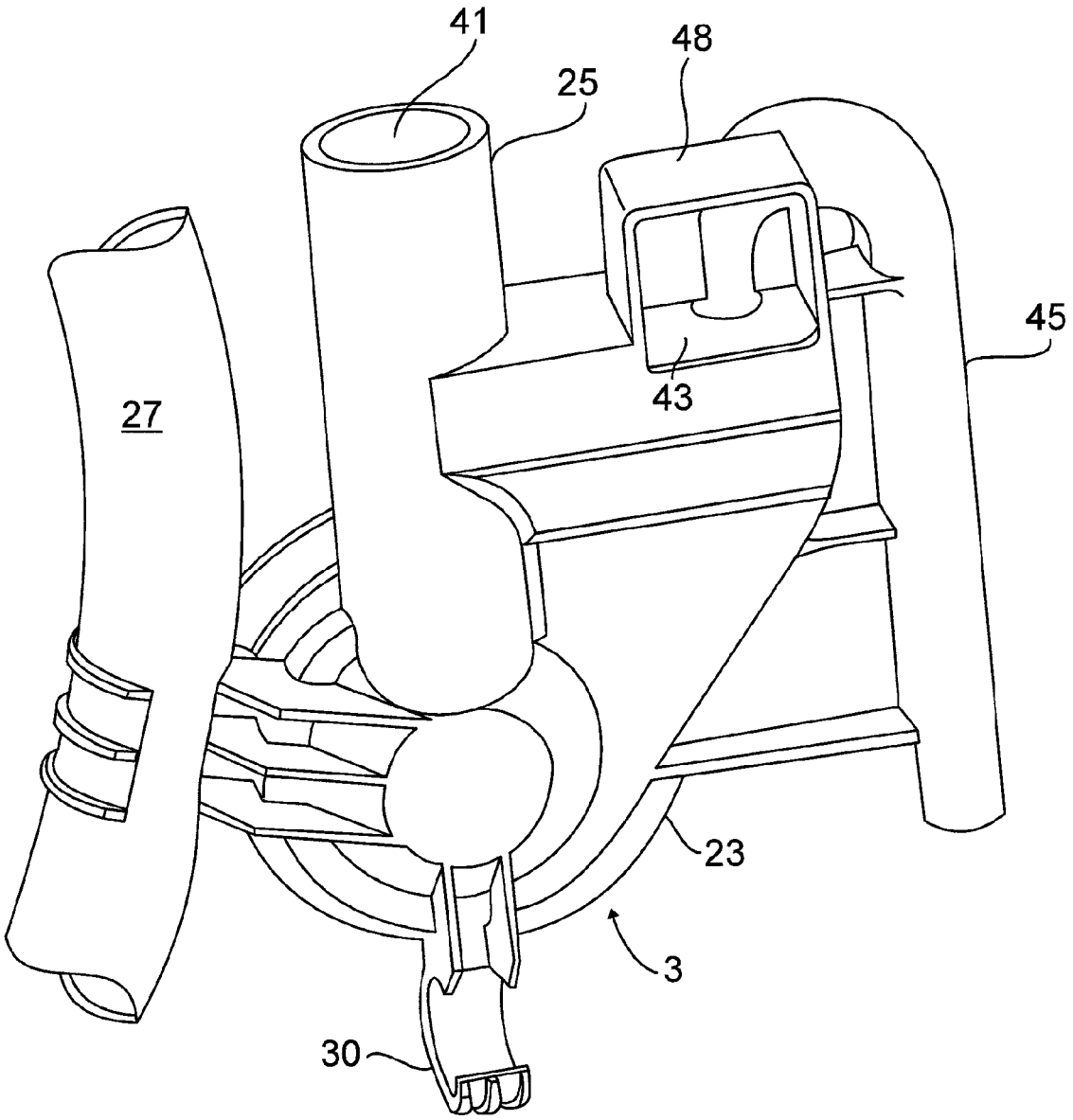
FIG. 2 shows the detail Z from FIG. 1 in an enlarged detail view.

Both the steam outlet opening 41 of the steam outlet chamber 37 and the inlet opening 43 of the water inlet chamber 35 are provided on the top side of the housing 23. According to FIG. 2, the inlet opening 43 has a rectangular cross-section into which projects a feed conduit 45 integrated on the housing 23. A free ventilation space s is provided between the end of the feed conduit 45 projecting into the water inlet chamber 35 and the edge 46 of the inlet opening 43. The free opening cross-section of the inlet opening 43 is covered by means of a hood-like cover 48 which is integrally molded on the housing 23 and embodied as open toward the outside in an appliance-side direction x. The inlet opening 43 exposed toward the outside therefore serves in addition as a ventilation opening.

The water feed line 21 is connected at the downward-projecting end of the feed conduit 45.

In order to fill the washing container 1 with fresh water, the water inlet valve (not shown) is opened in the usual manner, thereby allowing the fresh water to flow in via the water feed line 21 and via the feed conduit 45 into the water inlet chamber 35 of the housing 23. From there the fresh water flows onward in the direction of the arrow I via the connection opening 39 into the steam outlet chamber 37 and into the washing chamber 4.

Steam flowing into the housing 23 during pressure equalization is reliably prevented from penetrating into the water feed line 21 by the inventive geometry of the housing 23. This case is simulated in the course of a safety test by the relevant test institutes in that the water feed line 21 is subjected to negative pressure during the pressure equalization.

According to the invention the water vapor coming from the washing chamber 4 is not sucked into the feed line 21 during an exposure to negative pressure of said kind. Rather, ambient air is sucked into the feed conduit 45 via the ventilation space s and via the inlet opening 43.

In addition the water inlet chamber 35 is inserted between the steam outlet chamber 37 and the inlet opening 43, thereby increasing the physical distance between the container opening 42 and the water inlet opening 43. Owing to the base-side arrangement of the connection opening it is also ensured that the upward-rising steam is routed past the connection opening directly to the steam outlet opening 41.

The invention claimed is:

1. A dishwasher comprising:

a washing container having a washing chamber;

a water feed line for filling the washing chamber with liquid; and a water inlet device connected on an inlet side to the water feed line and ending in the washing chamber on an outlet side, the water inlet device having a washing container opening at the outlet side that fluidly connects the water inlet device to the washing container;

a water inlet chamber that fluidly connects to the water feed line;

a steam outlet chamber;

a steam outlet opening that ducts water vapor in the steam outlet chamber out of the washing container;

an expansion line fluidly connected to the steam outlet opening and located vertically above the steam outlet opening such that the water vapor rises in the expansion line to a position vertically higher than the steam outlet opening, the expansion line being configured to promote condensing of the water vapor in the expansion line such that the condensed water vapor falls vertically down the expansion line and through the steam outlet opening;

a ventilation opening separate from the steam outlet opening, the ventilation opening supplying air from outside the washing container to the water feed line; and a hood partially covering the ventilation opening, wherein the water inlet device prevents a negative-pressure-induced reversal of flow against the filling direction in the water feed line, the expansion line and the steam outlet opening fluidly connect the steam outlet chamber to an environment outside the water inlet device at a first location, the ventilation opening fluidly connects the water feed line to the environment outside the water inlet device at a second location, the second location is different from the first location such that the air supplied to the water feed line through the ventilation opening does not enter the water inlet device through the steam outlet opening, and the ventilation opening equalizes pressure if negative pressure occurs in the water feed line.

2. The dishwasher of claim 1, wherein the water inlet device comprises a housing.

3. The dishwasher of claim 2, wherein one of the ventilation opening and the steam outlet opening is on a top side of the housing.

4. The dishwasher of claim 1, wherein the water inlet device comprises a steam duct that guides steam to the steam outlet opening.

5. The dishwasher as claimed in claim 1, wherein the water inlet device defines a connection opening that connects the water inlet chamber and the steam outlet chamber.

6. The dishwasher of claim 5, wherein a container opening connects the steam outlet chamber and the washing chamber of the washing container.

7. The dishwasher of claim 4, wherein a cross-section of an opening between the washing chamber and the water feed line is smaller than a cross-section of an opening between the washing chamber and the steam outlet opening.

8. The dishwasher of claim 4, wherein the steam duct has a curved section.

9. The dishwasher of claim 1, wherein a cross-section of an opening between the washing chamber and the water feed line is smaller than a cross-section of an opening between the washing chamber and the steam outlet opening.

10. The dishwasher of claim 1, wherein the ventilation opening is an opening in the water inlet chamber.

11. The dishwasher of claim 10, wherein the water inlet chamber is separated from the steam outlet chamber by a partition having an opening.

12. The dishwasher of claim 10, wherein the steam outlet opening is located directly vertically above the outlet side of the water inlet device.

13. The dishwasher of claim 1, wherein the steam outlet opening is located directly vertically above the outlet side of the water inlet device.

14. The dishwasher of claim 5, wherein the water inlet chamber is separated from the steam outlet chamber by a partition, a bottom end of the partition located at a lowest vertical point of the partition defines the top edge of the connection opening, a lower wall of the water inlet chamber is non-horizontal at a point directly vertically below the bottom end of the partition, and the lower wall of the water inlet chamber at the point directly vertically below the bottom end of the partition is configured such that water flows through the connection opening without having to move vertically upward.

15. The dishwasher of claim 14, wherein the steam outlet opening is located directly vertically above the outlet side of the water inlet device.

16. The dishwasher of claim 14, wherein the expansion line is located vertically above the ventilation opening.

17. The dishwasher of claim 1, wherein the expansion line is located vertically above the ventilation opening.

18. A dishwasher comprising:

a washing container having a washing chamber;

a water feed line for filling the washing chamber with liquid; and a water inlet device connected on an inlet side to the water feed line and ending in the washing chamber on an outlet side, the water inlet device having a washing container opening at the outlet side that fluidly connects the water inlet device to the washing container;

a water inlet chamber that fluidly connects to the water feed line;

a steam outlet chamber;

a steam outlet opening that ducts water vapor in the steam outlet chamber out of the washing container;

an expansion line fluidly connected to the steam outlet opening and located vertically above the steam outlet opening such that the water vapor rises in the expansion line to a position vertically higher than the steam outlet opening, the expansion line being configured to promote condensing of the water vapor in the expansion line such that the condensed water vapor falls vertically down the expansion line and through the steam outlet opening;

a ventilation opening separate from the steam outlet opening, the ventilation opening supplying air from outside the washing container to the water feed line, and a retaining element externally on the water inlet device for retaining liquid lines, wherein the water inlet device prevents a negative-pressure-induced reversal of flow against the filling direction in the water feed line, the expansion line and the steam outlet opening fluidly connect the steam outlet chamber to an environment outside the water inlet device at a first location, the ventilation opening fluidly connects the water feed line to the environment outside the water inlet device at a second location, and the second location is different from the first location such that the air supplied to the water feed line through the ventilation opening does not enter the water inlet device through the steam outlet opening.

19. The dishwasher of claim 18, wherein the steam outlet opening is located directly vertically above the outlet side of the water inlet device.

20. The dishwasher of claim 18, wherein the water inlet chamber is separated from the steam outlet chamber by a partition, a bottom end of the partition located at a lowest vertical point of the partition defines the top edge of the connection opening, a lower wall of the water inlet chamber is non-horizontal at a point directly vertically below the bottom end of the partition, and the lower wall of the water inlet chamber at the point directly vertically below the bottom end of the partition is configured such that water flows through the connection opening without having to move vertically upward.

* * * * *